US005671535A

United States Patent [19]

Van Der Borst et al.

[11] Patent Number: 5,671,535

[45] Date of Patent: Sep. 30, 1997

[54] SHAVING APPARATUS WITH CONTROLLABLE MOTOR SPEED

[75] Inventors: Albertus J. C. Van Der Borst; Jan Tiesinga; Jacobus N. Dekker; Ate K. Damstra, all of Drachten, Netherlands

[73] Assignee: U.S. Philips Corporation, New York, N.Y.

[21] Appl. No.: 455,125

[22] Filed: May 31, 1995

[30] Foreign Application Priority Data

Jun. 1, 1994 [EP] European Pat. Off. ..... 94201558

[51] Int. Cl.[6] ..... B26B 19/14

[52] U.S. Cl. ..... 30/43.6; 30/43.92

[58] Field of Search ..... 30/43.6, 43.9, 30/43.92, 45

[56] References Cited

U.S. PATENT DOCUMENTS 4,719,698 1/1988 Ninomiya et al. ..... 30/43.92 X
5,014,428 5/1991 Yamashita ..... 30/43.6

FOREIGN PATENT DOCUMENTS 0386999 9/1990 European Pat. Off. .

*Primary Examiner*—Douglas D. Watts
*Attorney, Agent, or Firm*—Ernestine C. Bartlett

[57] ABSTRACT

A shaving apparatus (1, 101, 201) is provided which includes at least one cutting unit (11) which is provided with an external cutting member (13) with at least one hair trap opening (17) and with an internal cutting member (19) which is rotatable in the external cutting member (13) by means of an electric motor (23). The speed of the motor (23) can be controlled during operation by a feedforward control unit (43, 103, 203) as a function of at least one physical quantity which can be measured during operation by means of a transducer (59, 69, 111).

A first embodiment of the shaving apparatus (1) comprises a timer (59) which measures a time which has elapsed during a shaving operation, and a detector (69) with a microphone (71) which measures a cutting frequency of the cutting unit (11), the speed of the motor (23) being controllable by the control unit (43) as a function of the time which has elapsed during the shaving operation and of the cutting frequency. A second embodiment of the shaving apparatus (101) comprises a force detector (111) which measures a skin contact force exerted on the cutting unit (11), and again a detector (69) with a microphone (71) measuring a cutting frequency of the cutting unit (11), so that the speed of the motor (23) can be controlled by the control unit (103) as a function of the skin contact force and the cutting frequency. In a special embodiment, the control unit (43, 103, 203) controls the speed of the motor (23) in accordance with an algorithm based on fuzzy logic.

The shaving apparatus (1, 101, 201) provides a user of the shaving apparatus (1, 101, 201) with an optimum balance between shaving performance, shaving comfort and power consumption of the motor (23) during a shaving operation.

55 Claims, 11 Drawing Sheets

| inputs | | output |
|---|---|---|
| U%T | $U_F$ | $U_R$ |
| B | L | 4 |
| | L/M | 5 |
| | M | 6 |
| | M/H | 8 |
| | H | 9 |
| M | L | 2 |
| | L/M | 3 |
| | M | 5 |
| | M/H | 7 |
| | H | 9 |
| E | L | 1 |
| | L/M | 2 |
| | M | 4 |
| | M/H | 6 |
| | H | 9 |

FIG. 5

| inputs | | output |
|---|---|---|
| $U_F$ | $U_C$ | $U_R$ |
| L | L | 5 |
| | L/M | 4 |
| | M | 3 |
| | M/H | 2 |
| | H | 1 |
| L/M | L | 6 |
| | L/M | 5 |
| | M | 4 |
| | M/H | 3 |
| | H | 2 |
| M | L | 7 |
| | L/M | 6 |
| | M | 5 |
| | M/H | 4 |
| | H | 3 |

FIG. 8A

| inputs | | output |
|---|---|---|
| $U_F$ | $U_C$ | $U_R$ |
| M/H | L | 8 |
| | L/M | 7 |
| | M | 6 |
| | M/H | 5 |
| | H | 4 |
| H | L | 9 |
| | L/M | 8 |
| | M | 7 |
| | M/H | 6 |
| | H | 5 |

FIG. 8B

| inputs | | | output |
|---|---|---|---|
| $u_S$ | $u_C$ | $u_{\%T}$ | $u_R$ |
| C | L | B | 6 |
| | | M | 5 |
| | | E | 4 |
| | M | B | 5 |
| | | M | 4 |
| | | E | 3 |
| | H | B | 4 |
| | | M | 3 |
| | | E | 2 |

FIG. 11A

| inputs | | | output |
|---|---|---|---|
| $u_S$ | $u_C$ | $u_{\%T}$ | $u_R$ |
| M | L | B | 6 |
| | | M | 5 |
| | | E | 4 |
| | M | B | 6 |
| | | M | 5 |
| | | E | 4 |
| | H | B | 6 |
| | | M | 5 |
| | | E | 4 |

FIG. 11B

| inputs | | | output |
|---|---|---|---|
| $u_S$ | $u_C$ | $u_{\%T}$ | $u_R$ |
| P | L | B | 6 |
| | | M | 5 |
| | | E | 4 |
| | M | B | 7 |
| | | M | 6 |
| | | E | 5 |
| | H | B | 8 |
| | | M | 7 |
| | | E | 6 |

FIG. 11C

SHAVING APPARATUS WITH CONTROLLABLE MOTOR SPEED

FIELD OF THE INVENTION

The invention relates to a shaving apparatus with at least one cutting unit which is provided with an external cutting member with at least one hair trap opening and an internal cutting member which can be driven relative to the external cutting member by an electric motor, which motor has a speed which is controllable by means of an electrical control unit.

BACKGROUND OF THE INVENTION

A shaving apparatus of the kind mentioned in the opening paragraph is known from European Patent Application 0 386 999. The speed of the electric motor of the known shaving apparatus is detectable by means of an optical sensor which is provided with a light source and a photosensor which are fastened to a housing of the shaving apparatus near a motor shaft of the motor in conjunction with a reflecting mark provided on the motor shaft. The control unit of the known shaving apparatus is a feedback control unit with a comparator which compares a motor speed measured by the optical sensor with a motor speed reference value. The control unit controls the speed of the electric motor such that the motor speed during operation is continuously equal to the reference value. The shaving apparatus thus has a constant speed during operation which is not influenced by the load exerted on the cutting unit.

The shaving performance, i.e. the speed of the shaving process and the skin smoothness achieved during a shaving operation, the shaving comfort, i.e. the level of skin irritation experienced by a user of the known shaving apparatus during a shaving operation, and the power consumption of the known shaving apparatus depend on the speed of the electric motor. The reference value of the motor speed, which is maintained by the control unit during a shaving operation, has been predetermined in such a manner that a favorable balance is provided between the shaving performance, shaving comfort, and power consumption for a predetermined average user of the known shaving apparatus during a predetermined average duration of the shaving operation.

A disadvantage of the known shaving apparatus is that said favorable balance between shaving performance, shaving comfort, and power consumption is not achieved for every user of the shaving apparatus. Since the shaving performance, shaving comfort, and power consumption depend on a number of physical quantities which are subject to major changes during a shaving operation, moreover, the motor speed kept constant in accordance with the reference value does not provide an optimum balance between shaving performance, shaving comfort and power consumption throughout the entire shaving operation.

SUMMARY OF THE INVENTION

It is an object of the invention to provide a shaving apparatus of the kind mentioned in the opening paragraph with which the balance between shaving performance, shaving comfort and power consumption during a shaving operation is improved.

The invention is for this purpose characterized in that the electrical control unit is a feedforward control unit which varies the motor speed in accordance with a predetermined control rule as a function of at least one physical quantity which is measurable by means of a transducer. The physical quantity measured by means of the transducer is a quantity which changes during a shaving operation and which affects the shaving performance, shaving comfort, and power consumption. The speed of the electric motor can be controlled during a shaving operation through a suitable design of the control unit and the control rule in such a manner that the most favorable balance possible between shaving performance, shaving comfort, and power consumption is maintained or provided upon a change in said physical quantity.

A special embodiment of a shaving apparatus according to the invention is characterized in that the transducer is capable of measuring a number of hairs cut by the cutting unit per unit time. Owing to the use of said transducer, the speed of the electric motor is controllable by means of the control unit during a shaving operation as a function of the number of hairs cut by the cutting unit per unit time. The number of hairs cut by the cutting unit per unit time depends on the number of hairs per unit skin surface, which depends on the location on the skin of a user of the shaving apparatus, and which varies strongly from one user to another. Since the shaving performance and the shaving comfort experienced by the user depend on the number of hairs per unit skin surface, the balance between shaving performance and shaving comfort is improved in that the motor speed is controlled in a suitable manner as a function of the number of hairs cut by the cutting unit per unit time.

A further embodiment of a shaving apparatus according to the invention is characterized in that the transducer is provided with a microphone capable of detecting an acoustic signal produced by the cutting unit, and with an electrical filter capable of filtering a cutting frequency from said acoustic signal. The cutting frequency measured by means of the microphone and the filter is the number of hair cutting operations carried out by the cutting unit per unit time, i.e. the number of hairs which the cutting unit cuts per unit time. The transducer of this construction is particularly simple and reliable and in addition requires a limited compartment space.

A yet further embodiment of a shaving apparatus according to the invention is characterized in that according to the control rule the motor speed increases with an increase in the measured number of hairs cut by the cutting unit per unit time. When the number of hairs cut by the cutting unit per unit time (cutting frequency) is comparatively great, the internal cutting member is displaced relative to the external cutting member under the influence of the cutting forces which occur, so that the shaving performance deteriorates. Since the motor speed is comparatively high at comparatively high cutting frequencies, the internal cutting member has a comparatively high mechanical angular momentum at high cutting frequencies, so that the movement of the internal cutting member relative to the external cutting member is comparatively stable and displacements of the internal cutting member relative to the external cutting member under the influence of the cutting forces are limited as much as possible. Since the motor speed is comparatively low at comparatively low cutting frequencies, the skin irritation level and the power consumption of the shaving apparatus are limited as much as possible in the case of comparatively low cutting frequencies.

A particular embodiment of a shaving apparatus according to the invention is characterized in that the transducer is capable of measuring a time which has elapsed during a shaving operation. With the use of this transducer, the speed of the electric motor can be controlled by the control unit during a shaving operation as a function of the time which has elapsed during the shaving operation. If it has been previously determined how the physical quantities which influence the shaving performance, shaving comfort and power consumption change during a shaving operation, the balance between the shaving performance, shaving comfort and power consumption is further improved in that the speed of the electric motor is varied in a suitable manner as a function of the time which has elapsed during a shaving operation.

A further embodiment of a shaving apparatus according to the invention is characterized in that the control unit is provided with a calculation unit for calculating an average shaving time over a number of preceding shaving operations, the control unit determining the time which has elapsed during a shaving operation in relation to the calculated average shaving time. Since the control unit determines the time which has elapsed during a shaving operation in relation to the calculated average shaving time, the speed of the electric motor can be so controlled by the control unit that an optimum balance between shaving performance, shaving comfort and power consumption is achieved for the user, provided the shaving operation takes place in the average shaving time. Thus a balance between shaving performance, shaving comfort and power consumption which is as favorable as possible is provided both for users with a comparatively long average shaving time and for users with a comparatively short average shaving time.

A still further embodiment of a shaving apparatus according to the invention is characterized in that according to the control rule the motor speed decreases with an increase in the time which has elapsed during a shaving operation. In an initial phase of a shaving operation, the hairs to be cut are still comparatively long and the hairs are initially shortened, while in an end phase of the shaving operation the desired smoothness is to be achieved by further shortening of the hairs. Since the motor speed has dropped in said end phase, the skin irritation level in the end phase, in which the user usually presses the cutting unit more firmly against the skin than in the initial phase in order to achieve the desired smoothness, is limited as much as possible.

A special embodiment of a shaving apparatus according to the invention is characterized in that the transducer is capable of measuring a skin contact force exerted on the cutting unit. With the use of this transducer, the motor speed can be controlled by the control unit during a shaving operation as a function of the skin contact force exerted on the cutting unit, which force depends on the force with which the user applies the shaving apparatus against the skin. Since the shaving performance, shaving comfort and power consumption of the motor depend on the value of said skin contact force, the balance between the shaving performance, shaving comfort and power consumption is improved in that the motor speed is controlled in a suitable manner as a function of the skin contact force measured by said transducer.

A further embodiment of a shaving apparatus according to the invention is characterized in that the transducer capable of measuring a number of hairs cut by the cutting unit per unit time is a first transducer of the shaving apparatus connected to a first electrical input of the control unit, and in that the transducer capable of measuring a time which has elapsed during a shaving operation is a second transducer of the shaving apparatus connected to a second electrical input of the control unit, which control unit has an electrical output for supplying an output signal which corresponds to a motor speed determined in accordance with the control rule. Owing to the use of the two transducers and the two electrical inputs, the speed of the electric motor can be controlled by the control unit as a function of both the time elapsed during a shaving operation and the number of hairs cut by the cutting unit per unit time, so that a particularly favorable balance between shaving performance, shaving comfort and power consumption of the shaving apparatus is maintained or provided during a shaving operation, while the speed of the electric motor is adapted to the peculiarities of the user to a high degree.

A yet further embodiment of a shaving apparatus according to the invention is characterized in that, for a predetermined increase in the measured number of hairs cut by the cutting unit per unit time, the motor speed increases comparatively little according to the control rule when the time which has elapsed during a shaving operation is comparatively short, and increases comparatively strongly when the time which has elapsed during a shaving operation is comparatively long. Since the motor speed increases comparatively strongly with an increase in the measured number of hairs cut by the cutting unit per unit time if the time which has elapsed during a shaving operation is comparatively long, a favorable balance between shaving performance and shaving comfort is also provided for users who shave a comparatively small portion of the skin smooth each time and subsequently shave a portion of the skin which is as yet unshaven, in which case the cutting frequency measured in the course of a shaving operation fluctuates comparatively strongly and comparatively high cutting frequencies are still measured also in a final phase of the shaving operation.

A special embodiment of a shaving apparatus according to the invention is characterized in that the transducer capable of measuring a number of hairs cut by the cutting unit per unit time is a first transducer of the shaving apparatus connected to a first electrical input of the control unit, and in that the transducer capable of measuring a skin contact force exerted on the cutting unit is a second transducer of the shaving apparatus connected to a second electrical input of the control unit, while the control unit has an electrical output for supplying an output signal which corresponds to a motor speed determined in accordance with the control rule. Owing to the use of the two transducers and the two electrical inputs, the motor speed can be controlled by the control unit as a function of both the number of hairs cut by the cutting unit per unit time and the skin contact force exerted on the cutting unit, so that a particularly favorable balance between shaving performance, shaving comfort experienced, and power consumption of the motor is maintained or provided during a shaving operation, while the motor speed is adapted to the peculiarities of the user to a high degree.

A further embodiment of a shaving apparatus according to the invention is characterized in that according to the control rule the motor speed decreases when the skin contact force exerted on the cutting unit increases. When the skin contact force exerted on the cutting unit increases, the skin penetrates more deeply into the hair trap opening of the external cutting member, so that the hairs are cropped shorter and the shaving performance increases. When the skin penetrates more deeply into the hair trap opening, however, the risk of contacts between the skin and the moving internal cutting member also increases. Since the motor speed decreases with an increasing skin contact force according to the control rule, the number of contacts between the skin and the internal cutting member, which number depends on the speed of the internal cutting member, is limited, so that an optimum shaving comfort is maintained in the case of an increasing skin contact force, while in addition the power consumption decreases.

A still further embodiment of a shaving apparatus according to the invention is characterized in that the transducer capable of measuring a time which has elapsed during a shaving operation is a first transducer of the shaving apparatus connected to a first electrical input of the control unit, and in that the transducer capable of measuring a skin contact force exerted on the cutting unit is a second transducer of the shaving apparatus connected to a second electrical input of the control unit, while the control unit has an electrical output for supplying an output signal which corresponds to a motor speed determined in accordance with the control rule. Owing to the use of the two transducers and the two electrical inputs, the motor speed can be controlled by the control unit as a function of both the time which has elapsed during a shaving operation and the skin contact force exerted on the skin, so that a particularly favorable balance between shaving performance, shaving comfort and power consumption of the shaving apparatus is maintained or provided during a shaving operation, while the motor speed is adapted to the peculiarities of the user to a high degree.

A special embodiment of a shaving apparatus according to the invention is characterized in that according to the control rule the motor speed is substantially independent of the skin contact force exerted on the cutting unit when the time which has elapsed during a shaving operation is comparatively short, whereas the motor speed decreases with an increase in the skin contact force exerted on the cutting unit when the time which has elapsed during a shaving operation is comparatively long. In an initial phase of a shaving operation the number of hairs yet to be cut is comparatively great, so that a comparatively high motor speed is required for obtaining a stable movement of the internal cutting member inside the external cutting member, and for limiting displacements of the internal cutting member relative to the external cutting member under the influence of the cutting forces. As the skin contact force increases, the number of hairs to be cut by the cutting unit per unit time increases, so that the motor speed required for keeping the internal cutting member stable increases. On the other hand, the risk of contact between skin and internal cutting member rises with an increasing skin contact force, so that the shaving comfort is maintained only if the motor speed decreases. Since the motor speed is substantially independent of the skin contact force in the initial phase according to the control rule, an optimum balance between the shaving performance and the shaving comfort is maintained when the skin contact force changes. In an end phase of the shaving operation, the hairs to be cut have already been shortened, so that the number of hairs to be cut by the cutting unit per unit time is substantially independent of the skin contact force. Since the motor speed decreases with an increasing skin contact force in the end phase, according to the control rule, the shaving comfort is maintained as much as possible with an increasing skin contact force and an increasing risk of contacts between the skin and the internal cutting member.

A further embodiment of a shaving apparatus according to the invention is characterized in that the control unit has an electrical input which is connected to an electrical output of an operational member with which a desired balance between shaving performance and shaving comfort can be set. A user of the shaving apparatus may adjust a balance desired by him between the shaving performance and shaving comfort by means of said operational member. The desired balance is achieved in that the control unit controls the motor speed in a suitable manner during the shaving process as a function of the measured physical quantity or quantities.

A still further embodiment of a shaving apparatus according to the invention is characterized in that the control rule controls the motor speed in accordance with an algorithm based on fuzzy logic. According to the algorithm based on fuzzy logic, a range of each input quantity for the control rule is subdivided into a number of classes, and a membership of one of the classes is instantaneously assigned to each input quantity in accordance with a membership function. The range of the output quantity of the control rule is also subdivided into a number of classes. The instantaneous class of the output quantity is determined in accordance with a logic rule as a function of the instantaneous classes of the input quantities determined in accordance with the membership functions. In this manner a desired behaviour of the shaving apparatus as a function of the input quantities may be laid down in the control rule in a simple manner. In addition, the desired behaviour of the shaving apparatus may be changed in a simple and flexible manner in a design phase if the knowledge of or insight into the operation of the shaving apparatus changes, or if other or supplementary input quantities are desired.

A particular embodiment of a shaving apparatus according to the invention is characterized in that the control unit has an electrical input which is connected to an electrical output of a sensor capable of measuring the speed of the electric motor. The use of the sensor renders it possible for the control unit to detect a difference between an actual motor speed measured by the sensor and a desired motor speed determined by the control unit in accordance with the control rule. The measured motor speed is rendered equal to the desired motor speed in that the motor is controlled in a suitable manner, so that an accurate motor speed control is provided.

BRIEF DESCRIPTION OF THE DRAWINGS

The invention will be explained in more detail below with reference to the drawing, in which FIG. 5 is a Table in which a class assigned to the output signal in accordance with a logic rule is shown in relation to the input signals of the processor of the control unit of FIG. 3, FIG. 8 is a Table showing the class assigned to the output signal in accordance with a logic rule in relation to the input signals of the processor of the control unit of FIG. 6, FIG. 11 is a Table in which a class assigned to the output signal in accordance with a logic rule is shown in relation to the input signals of the processor of the control unit of FIG. 9.

DETAILED DESCRIPTION OF THE PREFERRED EMBODIMENTS

Figure 1:
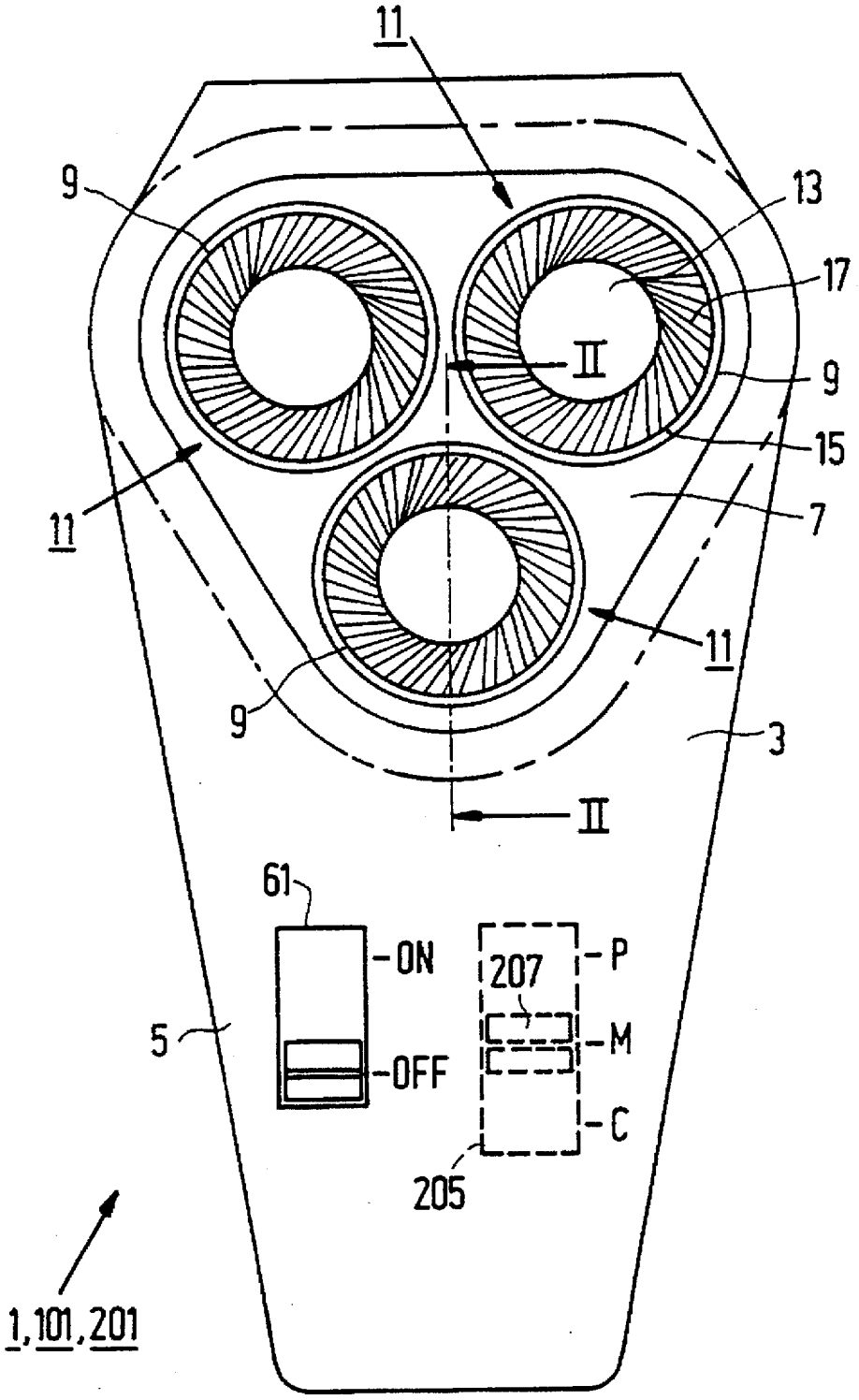
FIG. 1 shows a first, second, and third embodiment of a shaving apparatus according to the invention.

In FIGS. 1 to 11 and in the ensuing description, corresponding components of the first, second and third embodiments of the shaving apparatus 1, 101, 201, respectively, have been given the same reference numerals.

Figure 2:
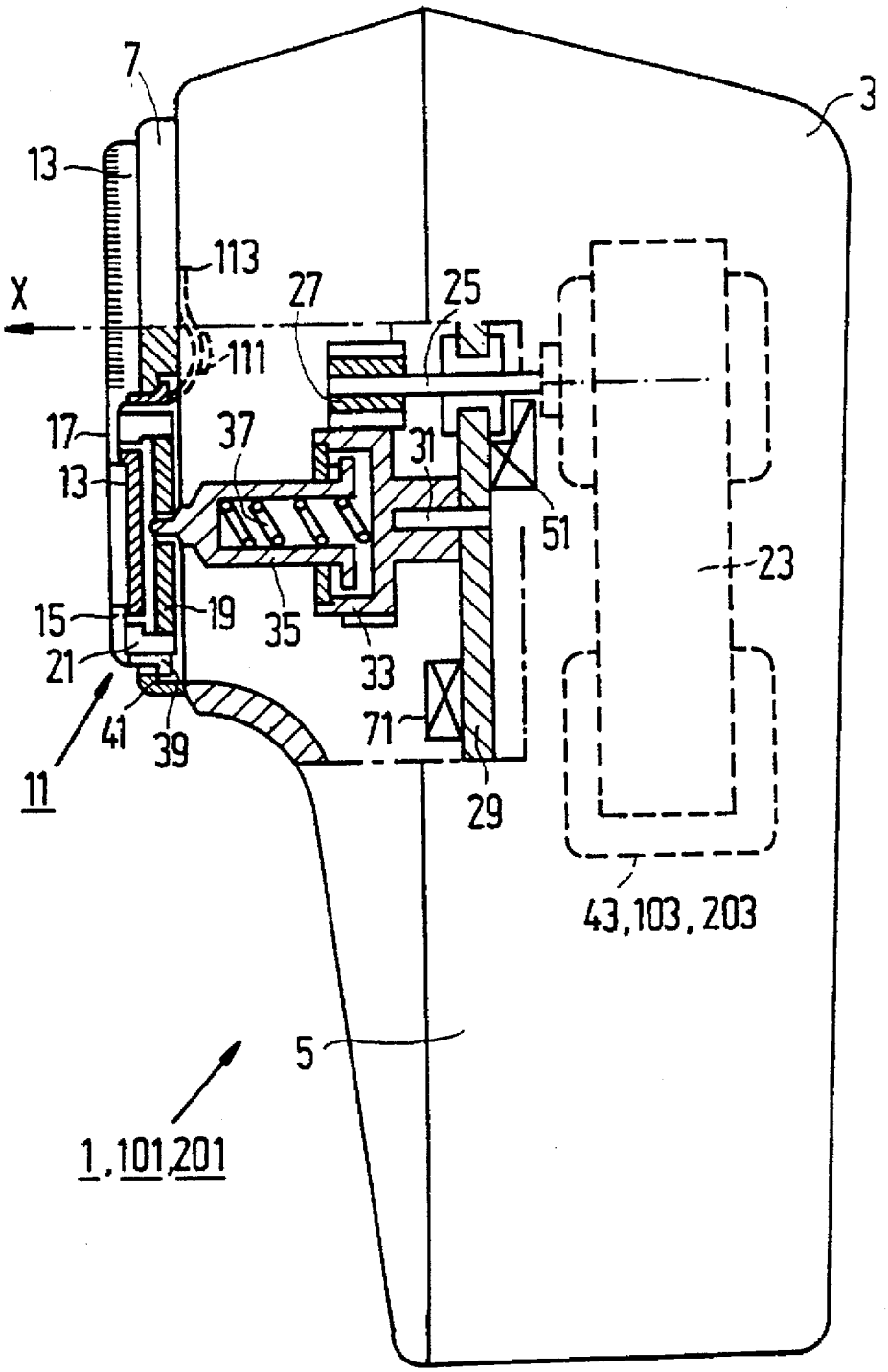
FIG. 2 is a cross-section taken on the line II—II in FIG. 1.

As FIG. 1 shows, the first, the second and the third embodiment of the shaving apparatus 1, 101, 201, according to the invention have a housing 3 with a handle 5 for a user of the shaving apparatus 1, 101, 201. The housing 3 has a holder 7 in which three round openings 9 are provided in triangular arrangement. A round cutting unit 11 is provided in each opening 9 of the holder 7. The cutting units 11 each have an external cutting member 13 which is provided with an annular rim 15 with slotted hair trap openings 17. As FIG. 2 shows, the cutting units 11 further comprise an internal cutting member 19 with a rim of cutters 21 which are arranged in the rim 15 of the external cutting member 13. The internal cutting members 19 are rotatable relative to the external cutting members 13 by means of an electric motor 23 which is arranged in the housing 3, which has an output shaft 25 with a pinion 27, and which is fastened to a mounting plate 29. Three bearing pins 31 are further mounted on the mounting plate 29, by means of which pins three gears 33 are journalled relative to the mounting plate 29. The three gears 33 are in engagement with the pinion 27 of the output shaft 25 of the motor 23 and are each coupled to a hollow drive shaft 35 for one of the internal cutting members 19. As FIG. 2 shows, the drive shafts 35 are slidable in a direction parallel to an axial direction X relative to the gears 33. A mechanical helical spring 37 is fastened between each gear 33 and its drive shaft 35, whereby the internal cutting members 19 are kept in the external cutting members 13 under the influence of a pretensioning force of the helical springs 37, while the external cutting members 13 bear with rims 39 against an inside 41 of the holder 7 under the influence of the pretensioning force of the helical springs 37. It is noted that FIG. 2 shows only one external cutting member 13, one internal cutting member 19, one bearing pin 31, one gear 33, one drive shaft 35, and one helical spring 37 in cross-section.

When the user applies the shaving apparatus 1, 101, 201 against his skin during operation, the hairs present on the skin penetrate the hair trap openings 17 of the external cutting members 13 and are subsequently cut off through cooperation between the edges of the hair trap openings 17 and the cutters 21 of the internal cutting members 19 rotating in the external cutting members 13. The cutting units 11 are displaced relative to the holder 7 against the pretension of the helical springs 37 under the influence of a skin contact force between the skin and the external cutting members 13 exerted by the user. When said skin contact force is comparatively great, the cutting units 11 are displaced under the influence of the skin contact force into a position in which the external cutting members 13 are substantially recessed in the holder 7. In this manner, bulging of the skin so far into the hair trap openings 17 at a comparatively great skin contact force that the skin is damaged by the rotating cutters 21.

The first, the second and the third embodiment of the shaving apparatus 1, 101, 201 are each provided with an electrical control unit 43, 103, 203 capable of controlling the speed of the motor 23 during operation in a manner to be described below. The shaving performance of the shaving apparatus 1, 101, 201, i.e. the speed of the shaving process and the smoothness achieved during a shaving operation, the shaving comfort, i.e. the skin irritation level experienced by the user during the shaving operation, and the power consumption of the motor 23 are dependent on the speed of the motor 23. At a comparatively high motor speed, a comparatively large number of hairs are cut per unit time, so that the shaving performance is comparatively high. At a comparatively high motor speed, however, the number of contacts made per unit time by the cutters 21 with the skin bulging into the hair trap openings 17 is also comparatively great, so that the skin irritation level is comparatively high and the shaving comfort accordingly comparatively low. In addition, the power consumption of the motor 23 is comparatively high at a comparatively high speed. At a comparatively low motor speed, a comparatively small number of hairs are cut per unit time so that the shaving performance is comparatively low. At a comparatively low motor speed, the number of contacts made per unit time by the cutters 21 with the skin bulging into the hair trap openings 17 is comparatively small, so that the skin irritation level is comparatively low and the shaving comfort comparatively high. The power consumption of the motor 23 is comparatively low at a comparatively low motor speed. The shaving performance, shaving comfort and power consumption in addition depend on a number of physical quantities such as, for example, a number of peculiarities of the user which change during a shaving operation and are also different from one user to another. The speed of the motor 23 is controlled by the control unit 43, 103, 203 as a function of a number of physical quantities to be described in more detail below in such a manner that an optimum balance between a shaving performance, shaving comfort and power consumption is maintained or achieved for the user during a shaving operation in spite of changes in said physical quantities.

Figure 3:
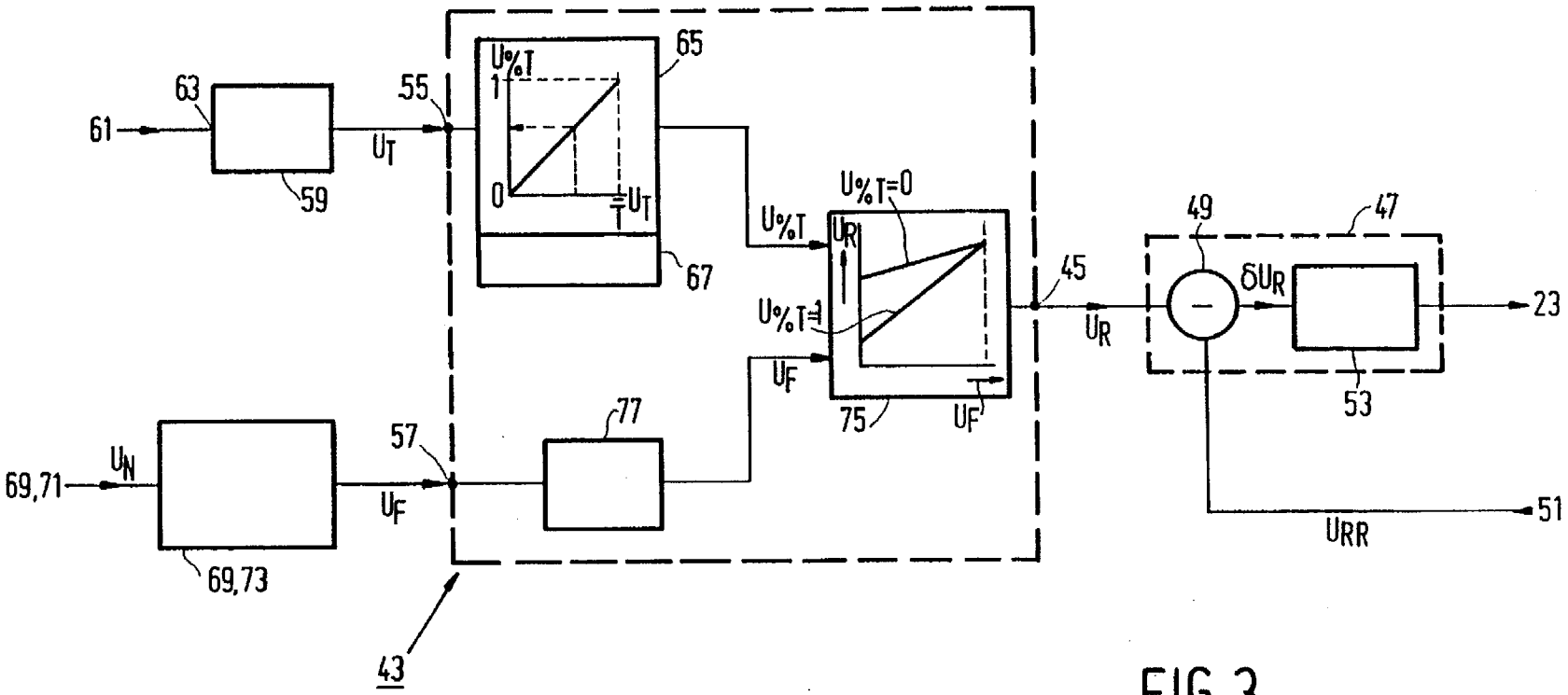
FIG. 3 is a block diagram of a control unit of the first embodiment of the shaving apparatus of FIG. 1.
Figure 6:
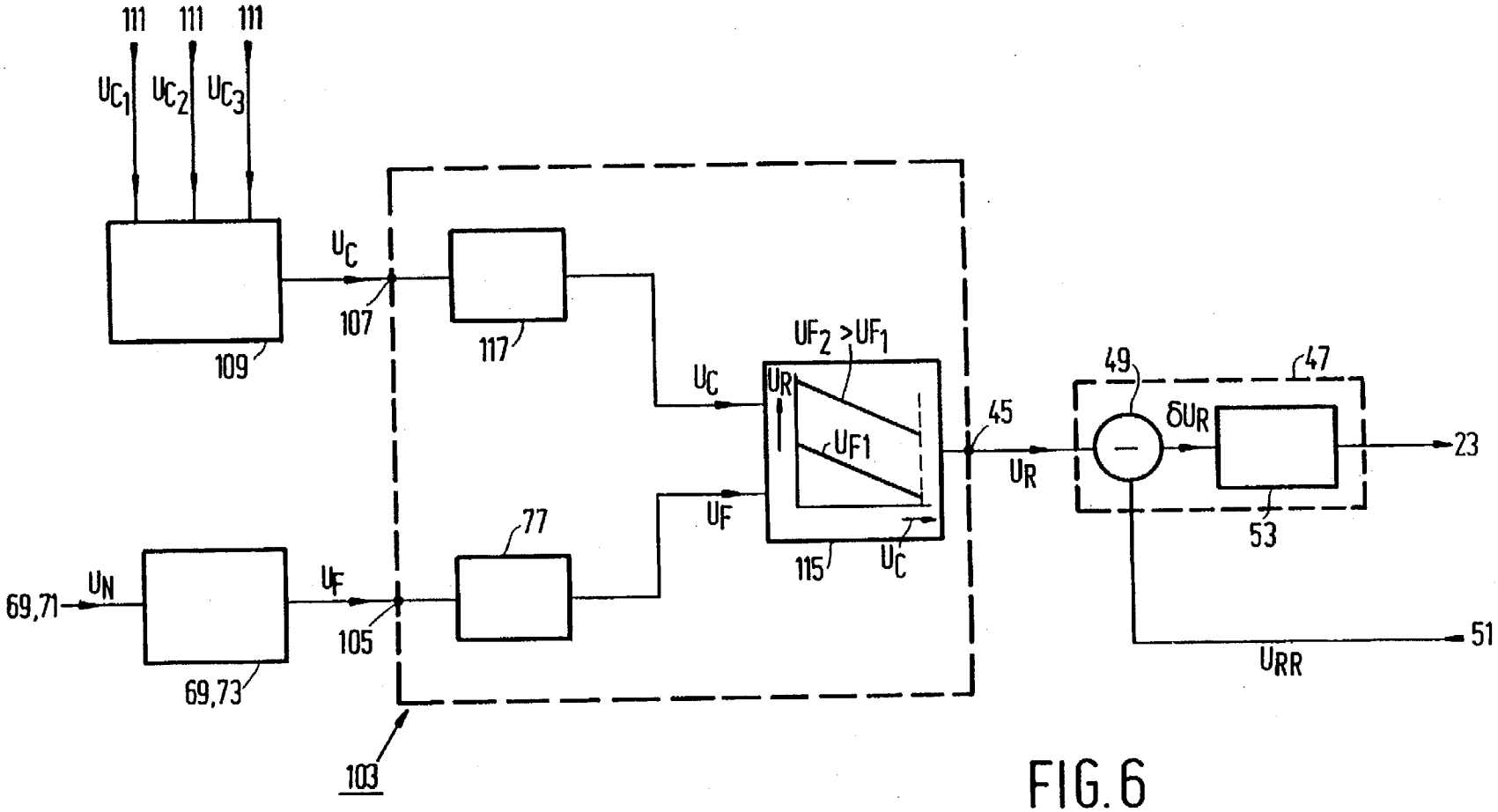
FIG. 6 is a block diagram of a control unit of the second embodiment of the shaving apparatus according to FIG. 1.
Figure 9:
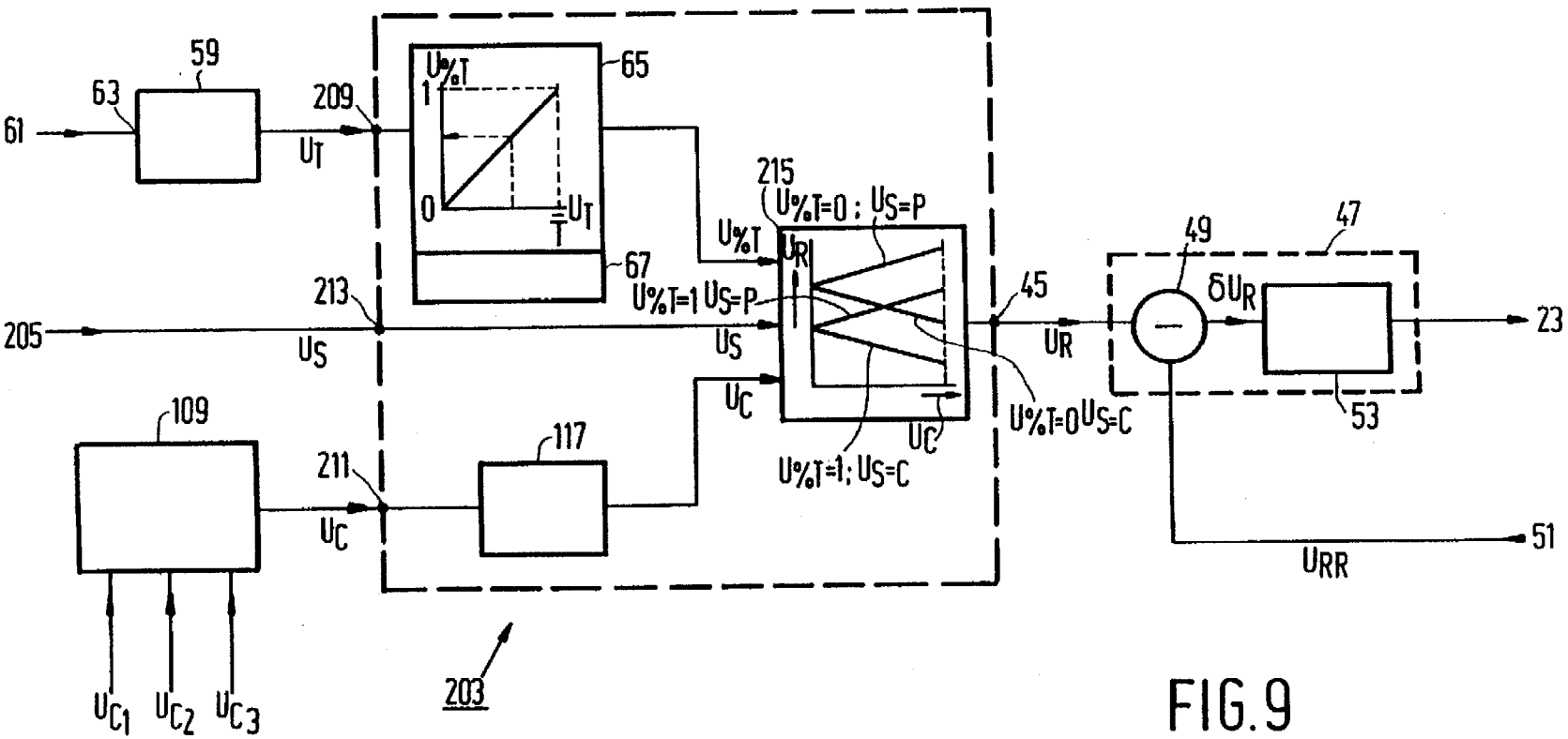
FIG. 9 is a block diagram of a control unit of the third embodiment of the shaving apparatus according to FIG. 1.
Figure 10A:
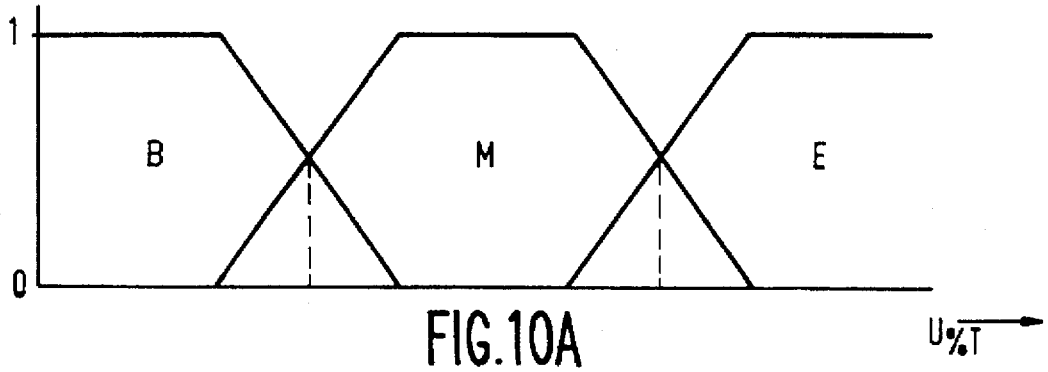
FIG. 10 shows membership functions based on fuzzy logic of the input signals and the output signal of a processor of the control unit of FIG. 9.
Figure 10B:
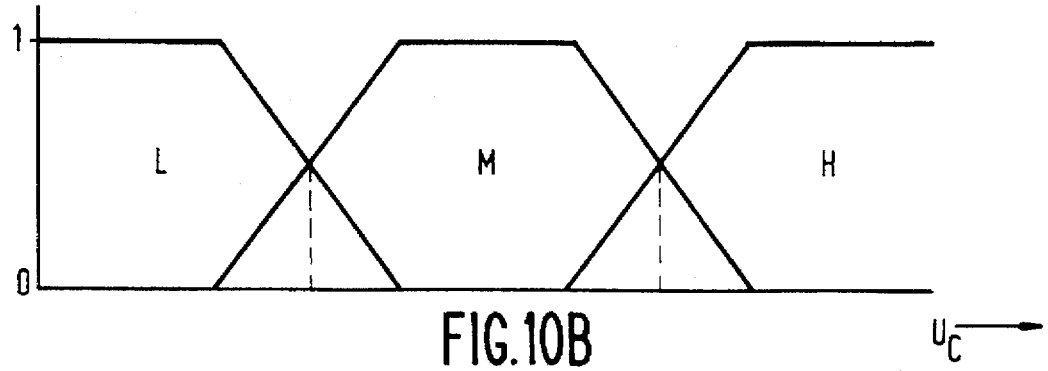
Figure 10C:
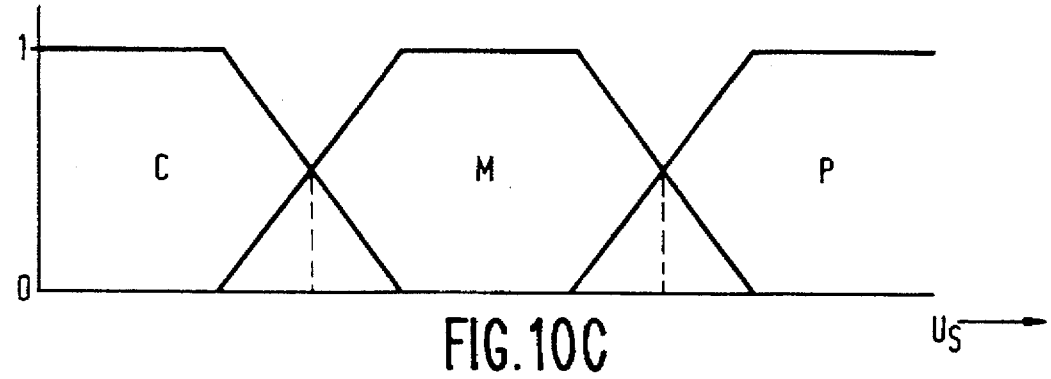
Figure 10D:
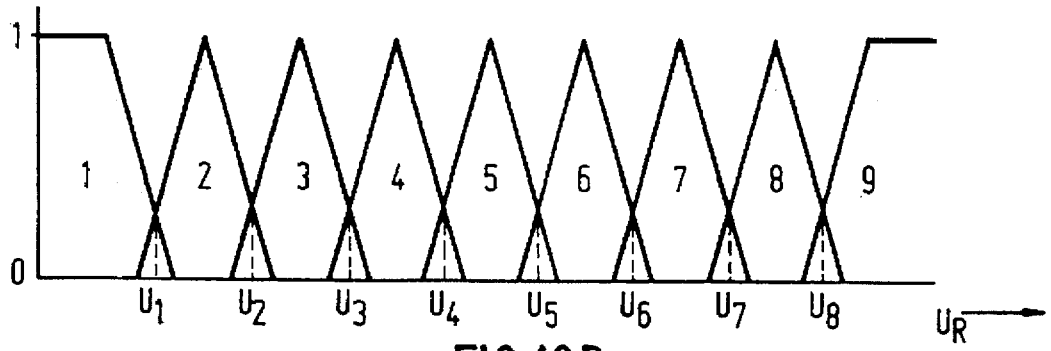

As FIGS. 3, 6 and 9 show, the control units 43, 103, 203 of the first, second and third embodiments of the shaving apparatus 1, 101, 201, each have an electrical output 45 for supplying an electrical output signal $u_R$ which corresponds to a certain desired speed of the motor 23 determined by the control unit 43, 103, 203. The output signal $u_R$ is offered to a known, usual electrical supply unit 47 of the motor 23. The supply unit 47 comprises a comparator 49 which compares the output signal $u_R$ with a signal $u_{RR}$ which forms an input signal of the comparator 49 and is supplied by a known, usual sensor 51 as depicted in FIG. 2, which measures the speed of the output shaft 25 of the motor 23. The supply unit 47 further comprises a known, usual controller 53 which controls the electrical supply voltage or current for the motor 23 such that a differential signal $\delta u_R = u_R - u_{RR}$ supplied by the comparator 49 is rendered equal to zero, and the measured speed of the motor 23 is rendered equal to the desired motor speed determined by the control unit 43, 103, 203. It is noted that the comparator 49 and the controller 53 may alternatively be included in the control unit 43, 103, 203, in which case the output signal of the control unit 43, 103, 203 is the output signal of the controller 53.

The physical quantities as a function of which the speed of the motor 23 of the first embodiment of the shaving apparatus 1 is controlled by the control unit 43 are the time (T) which has elapsed during a shaving operation and the number of hairs cut by the cutting units 11 per unit time (cutting frequency F). As FIG. 3 shows, the control unit 43 of the first embodiment of the shaving apparatus 1 for this purpose has a first electrical input 55 for receiving a first electrical input signal $u_T$ which corresponds to a time T which has elapsed during a shaving operation, and a second electrical input 57 for receiving a second electrical input signal $u_F$ which corresponds to the cutting frequency F, i.e. the number of hairs cut by the cutting units 11 per unit time. The control unit 43 controls the speed of the motor 23 in a manner to be described further below in dependence on the two input signals $u_T$ and $u_F$ so that a particularly favorable balance between the shaving performance, shaving comfort, and power consumption of the shaving apparatus 1 is maintained or provided during a shaving operation, and the speed of the motor 23 is adapted to the peculiarities of the user to a high degree.

The first electrical input signal $u_T$ is supplied by a timer 59 which forms a first transducer of the shaving apparatus 1 and which measures the time which has elapsed from a moment at which the shaving apparatus 1 is switched on by the user by means of a switch 61 visible in FIG. 1. The timer 59 for this purpose comprises an electrical input 63 which is connected to the switch 61. The input signal $u_T$ is offered to a calculation unit 65 of the control unit 43. The calculation unit 65 has a memory 67 in which the total shaving time of a number, for example ten, of preceding shaving operations is stored. The calculation unit 65 calculates an average shaving time of said preceding shaving operations. An output signal $u_{\%T}$ of the calculation unit 65 corresponds to the quotient of the time elapsed during a shaving operation (input signal $u_T$) and the calculated average shaving time.

The second electrical input signal $u_F$ is delivered by a detector 69 which forms a second transducer of the shaving apparatus 1 and which is capable of measuring a number of hairs cut by the cutting units 11 per unit time (cutting frequency F). The detector 69 for this purpose comprises a microphone 71 such as, for example, a known, usual electret microphone which is provided on the mounting plate 29, as is visible in FIG. 2. The microphone 71 supplies an acoustic signal $u_N$ which corresponds to the noise produced by the cutting units 11 during operation while cutting hairs offered through the hair trap openings 17. The acoustic signal $u_N$ is applied to a known, usual electrical filter 73 of the detector 69 which filters the cutting frequency (input signal $u_F$) from the acoustic signal $u_N$, i.e. the number of hairs cut by the cutting units 11 per unit time.

As FIG. 3 further shows, the control unit 43 comprises a processor 75 which determines the output signal $u_R$, which corresponds to the desired speed of the motor 23, as a function of the output signal $u_{\%T}$ of the calculation unit 65 and the second input signal $u_F$. A further electrical filter 77 is connected between the second electrical input 57 and the processor 75, which filters comparatively short-period fluctuations in the input signal $u_F$, so that the speed of the motor 23 does not react instantaneously to quick, transient changes in the measured cutting frequency F. The desired motor speed is determined by the processor 75 in accordance with a control rule according to which the desired motor speed (output signal $u_R$) increases with an increase in the measured cutting frequency F (input signal $u_F$). During operation, the internal cutting members 19 are loaded by so-called cutting forces which occur during cutting of the hairs. The cutting forces have not only a component in the rotational direction of the internal cutting members 19, whereby the motor 23 is loaded, but also a component in the axial direction X. As a result of this axial component of the cutting forces, the internal cutting members 19 are displaced in axial direction relative to the external cutting members 13 against the pretensioning force of the helical springs 37, whereby the interspacing between the cutters 21 and the hair trap openings 17 increases and the shaving performance deteriorates. Since, according to the control rule, the speed of the motor 23 is comparatively high at comparatively high cutting frequencies F, the internal cutting members 19 have a comparatively high mechanical angular momentum at high cutting frequencies F, so that the rotational movement of the internal cutting members 19 is comparatively stable and axial displacements of the internal cutting members 19 relative to the external cutting members 13 under the influence of the occurring cutting forces are limited as much as possible. At comparatively low cutting frequencies F, the required stability of the internal cutting members 19 is comparatively low, so that according to the control rule the speed of the motor 23 in this situation is reduced. The skin irritation level and the power consumption of the motor 23 are thus limited as much as possible at comparatively low cutting frequencies F.

According to said control rule, furthermore, the desired speed of the motor 23 is reduced as the time elapsed during a shaving operation increases. In an initial phase of the shaving operation, the hairs to be cut are still comparatively long and they are only shortened a first time, whereas in an end phase of the shaving operation the desired smoothness is to be achieved in that the hairs are shortened further. It has been ascertained that an average user applies the shaving apparatus 1 more force fully against his skin in said end phase than in said initial phase in order to achieve the desired smoothness, so that the risk of damage to the skin bulging into the hair trap openings 17 is comparatively great for an average user in this end phase. Since the speed of the motor 23 drops in the end phase in accordance with the control rule, the skin irritation level is limited as much as possible in the end phase.

According to said control rule, finally, the increase in the desired speed of the motor 23 for a given increase in the cutting frequency F is comparatively small when the time which has elapsed during a shaving operation is comparatively short, and comparatively great when the elapsed time is comparatively long. It has been ascertained that there is a first class of users who treat the entire skin for a first time in the initial phase of the shaving operation and subsequently treat the entire skin a second time in the end phase of the shaving operation, whereby the desired final smoothness is achieved. There is also a second class of users, however, the so-called local shavers, who shave a comparatively small portion of the skin smooth each time, achieving the desired final smoothness each time, and subsequently shave another, as yet unshaven portion of the skin smooth. The measured cutting frequency F fluctuates strongly during a shaving operation for this class of users, and a high speed of the motor 23 is necessary periodically also in a late stage of the shaving operation. Since, according to the control rule, the speed of the motor 23 increases strongly with an increase in the measured cutting frequency in a late stage of the shaving operation, an optimum balance between shaving performance and shaving comfort is provided also for said second class of users.

Since the signal $u_{\%T}$ corresponds to the quotient of the time which has elapsed during a shaving operation and the average shaving time over a number of preceding shaving operations, the desired speed of the motor 23 is so determined by the processor 75 that an optimum balance is achieved for the user between shaving performance, shaving comfort and power consumption of the motor 23, provided the shaving operation takes place in the average shaving time. The best possible balance between shaving performance, shaving comfort and power consumption is thus achieved both for users with a comparatively long average shaving time and for users with a comparatively short average shaving time.

Figure 4A:
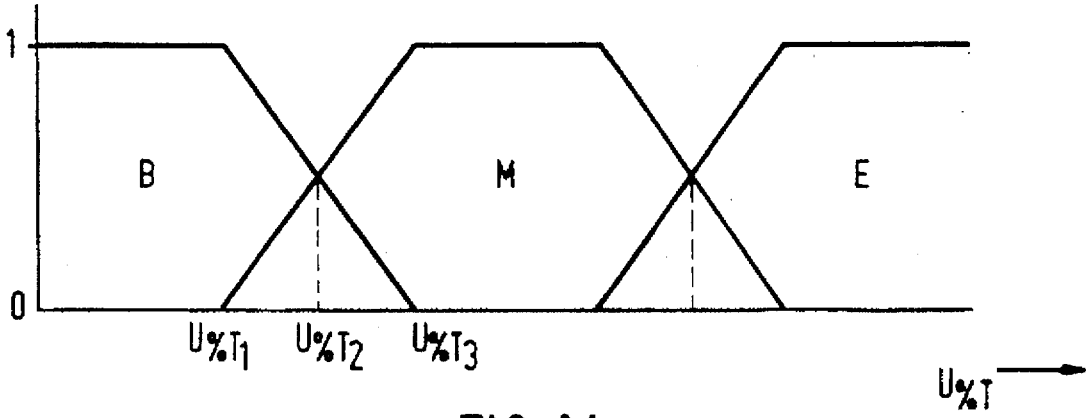
FIG. 4 shows membership functions based on fuzzy logic of the input signals and the output signal of a processor of the control unit of FIG. 3.
Figure 4B:
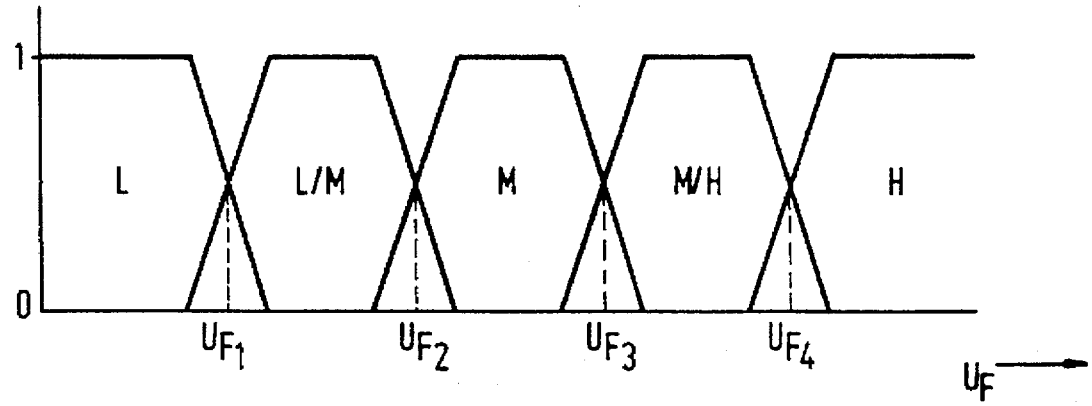
Figure 4C:
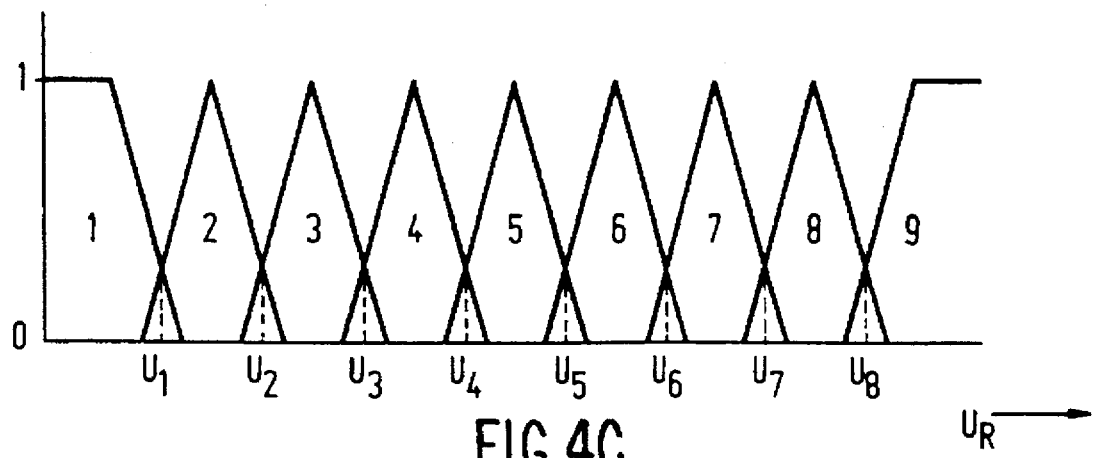

The control rule in accordance with which the control unit 43 determines the output signal $u_R$ as a function of the input signals $u_{\%T}$ and $u_F$ contains an algorithm based on so called fuzzy logic. According to this algorithm, a range of each of the input signals $u_{\%T}$, $u_F$ and of the output signal $u_R$ of the processor 75 of the control unit 43 is divided into a number of classes. FIG. 4 shows an embodiment of the classes into which the input signals $u_{\%T}$, $u_F$ and the output signal $u_R$ of the processor 75 are divided. As FIG. 4 shows, the range of the input signal $u_{\%T}$ is divided into the classes B (initial phase), M (middle phase) and E (end phase), while the range of the input signal $u_F$ is divided into the classes L (low), L/M (low to medium), M (medium), M/H (medium to high) and H (high). The output signal $u_R$ is divided into the classes 1 (lowest speed) up to 9 (highest speed). A membership of one of the relevant classes is continuously assigned to each of the input signals $u_{\%T}$ and $u_F$ by the processor 75 in accordance with a membership function. The membership functions of the input signals $u_{\%T}$ and $u_F$ are depicted in FIG. 4. The processor 75 assigns to the output signal $u_R$ a membership of one of the classes of the output signal $u_R$ during operation, determined in accordance with a logic rule as a function of the classes of the input signals $u_{\%T}$ and $u_F$ determined in accordance with the membership functions. FIG. 5 is a Table in which the class assigned to the output signal $u_R$ in accordance with said logic rule is shown in relation to the classes assigned to the input signals $u_{\%T}$ and $u_F$. It is noted that FIG. 5 only shows situations in which the input signals $u_{\%T}$ and $u_F$ each belong to only one class according to the membership functions. Alternatively, however, the input signals $u_{\%T}$ and $u_F$ may also belong to two or more classes. FIG. 4 shows, for example how the input signal $u_{\%T}$ belongs both to class B and to class M when the input signal $u_{\%T}$ lies between the limit values $u_{\%T1}$ and $u_{\%T3}$. In these situations, too, the processor 75 determines to which class or classes the output signal $u_R$ belongs in a known manner usual in fuzzy logic. The processor 75 also determines the value of the output signal $u_R$ in a known manner usual in fuzzy logic when the output signal $u_R$ belongs to two classes.

It is noted that the ranges of the input signals $u_{\%T}$ and $u_F$ and of the output signal $u_R$ of the processor 75 may alternatively be subdivided into more classes than those described above, and that the sub-ranges of the classes may also be differently distributed. The control of the desired speed of the motor 23 may be further refined in this manner. The desired behaviour of the shaving apparatus 1 may thus be laid down in a simple and visual manner in the control rule of the sub-processor 75 through the use of said algorithms based on fuzzy logic. The desired behaviour of the shaving apparatus 1 may in addition be changed in a simple and flexible manner in a design phase if the knowledge of the operation of the shaving apparatus 1 as a function of the speed of the motor 23 should change.

The physical quantities as a function of which the speed of the motor 23 of the second embodiment of the shaving apparatus 101 is controlled by the control unit 103 are the number of hairs cut by the cutting units 11 per unit time (cutting frequency F) and the skin contact force which is exerted during the shaving operation between the skin and the cutting units 11. As FIG. 6 shows, the control unit 103 for this purpose comprises a first electrical input 105 for receiving a first electrical input signal $u_F$ which corresponds to the cutting frequency F, and a second electrical input 107 for receiving a second electrical input signal $u_C$ which corresponds to the skin contact force exerted on the cutting units 11. The first electrical input signal $u_F$ is supplied by a detector 69 which is provided with a microphone 71 and an electrical filter 73 and which corresponds to the detector 69 in the first embodiment of the shaving apparatus 1 described above. The detector 69 forms a first transducer of the shaving apparatus 101. The second electrical input signal $u_C$ is supplied by a first processor 109. The first processor 109 calculates an average from three signals $u_{C1}$, $u_{C2}$ and $u_{C3}$, each corresponding to a respective skin contact force exerted on one of the cutting units 11, which is measured by means of a known, usual strain gauge sensor 111. As FIG. 2 shows, the strain gauge sensors 111 are each provided on a strip-shaped mechanical spring 113 which is fastened between the rim 39 of one of the external cutting members 13 and the holder 7. When the external cutting members 13 are displaced relative to the holder 7 against the pretensioning force of the helical springs 37 under the influence of a skin contact force, the strip-shaped springs 113 are elastically deformed. Since the mechanical stiffness of the helical springs 37 and of the strip-shaped springs 113 is a known quantity, it is possible to derive the skin contact force exerted on the individual cutting units 11 from the deformation of the strip-shaped springs 113 measured by the strain gauge sensors 111. The strain gauge sensors 111 form a second transducer of the shaving apparatus 101. It is noted that FIG. 2 shows only one strain gauge sensor 111 and one strip-shaped spring 113 by means of broken lines.

As FIG. 6 further shows, the control unit 103 comprises a second processor 115 which determines the output signal $u_R$, which corresponds to the desired speed of the motor 23, as a function of the first input signal $U_F$ and the second input signal $u_C$. An electrical filter 77 corresponding to the electrical filter 77 of the control unit 43 of the shaving apparatus 1 described above is connected between the first electrical input 105 and the second processor 115, while a further electrical filter 117 is connected between the second electrical input 107 and the second processor 115. The electrical filter 117 filters comparatively short-period changes in the input signal $u_C$, so that the speed of the motor 23 does not react instantaneously to fast and transient changes in the measured skin contact force.

The desired speed is determined by the second processor 115 in accordance with a control rule according to which the desired speed (output signal $u_R$) increases with an increase in the measured cutting frequency F (input signal $u_F$), while the desired speed decreases according to the control rule when the measured skin contact force (input signal ($u_C$) increases. Since the speed increases with an increase in the cutting frequency, a higher stability of the rotational movement of the internal cutting members 19 is provided when the cutting frequency rises, just as in the shaving apparatus 1, so that axial displacements of the internal cutting members 19 under the influence of the occurring cutting forces are avoided as much as possible. Since the speed decreases with an increase in the measured skin contact force according to the control rule, the number of contacts made between the skin, which bulges comparatively far into the hair trap openings 17 in the case of a strong skin contact force, and the rotating cutters 21 is limited as much as possible. An optimum shaving comfort is thus maintained also at a comparatively high skin contact force, while in addition the power consumption of the motor 23 is limited in the case of a comparatively high skin contact force.

Figure 7A:
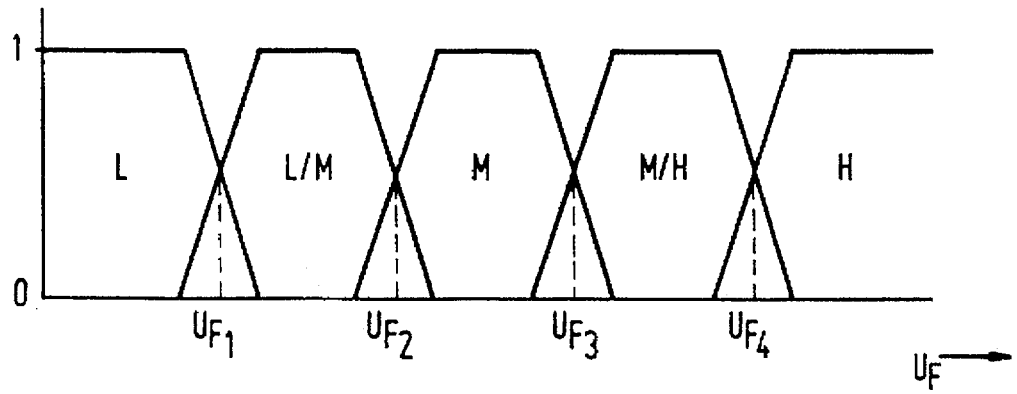
FIG. 7 shows membership functions based on fuzzy logic of the input signals and the output signal of a processor of the control unit of FIG. 6.
Figure 7B:
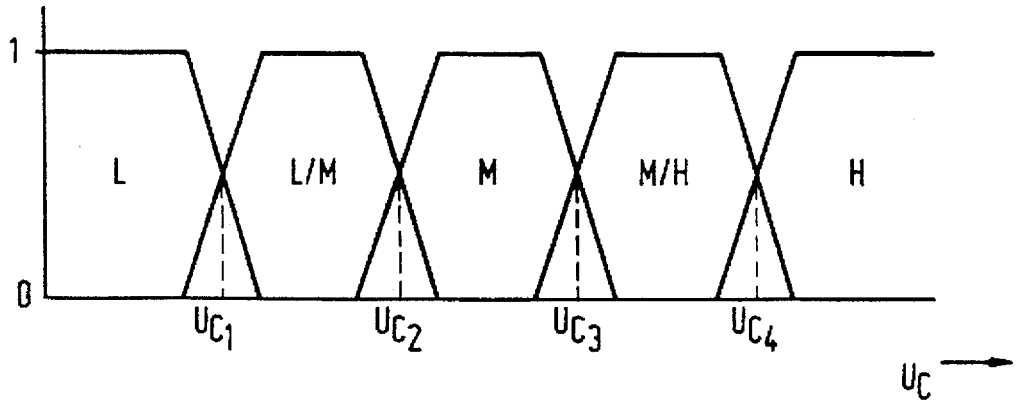
Figure 7C:
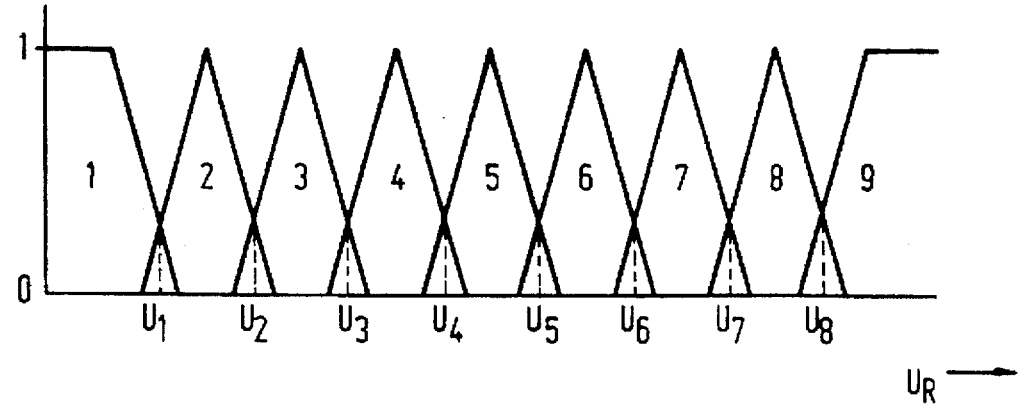

The control rule according to which the control unit 103 determines the output signal $u_R$ as a function of the input signals $u_F$ and $u_C$ contains, as does the control rule of the control unit 43 of the shaving apparatus 1, an algorithm based on fuzzy logic. FIG. 7 shows an embodiment of the classes and membership functions of the input signals $u_F$ and $u_C$ and the output signal $u_R$ of the second processor 115. The classes and the membership functions of the input signal $u_F$ and of the output signal $u_R$ correspond to the classes and membership functions of the input signal $u_F$ and the output signal $u_R$ of the processor 75 of the shaving apparatus 1 as shown in FIG. 4. The input signal $u_C$ is, as is the input signal $u_F$, divided into classes L (low), L/M (low to medium), M (medium), M/H (medium to high), and H (high). FIG. 8 is a Table showing the class assigned to the output signal $u_R$ by the second processor 115 in accordance with a logic rule in relation to the classes assigned to the input signals $u_F$ and $u_C$.

The physical quantities as a function of which the speed of the motor 23 of the third embodiment of the shaving apparatus 201 is controlled by the control unit 203 are the time (T) which has elapsed during a shaving operation and the skin contact force exerted on the cutting units 11 by the skin during the shaving operation. As FIG. 1 shows, the shaving apparatus 201 in addition comprises an operational member 205 by means of which a user of the shaving apparatus 201 can adjust a balance between the shaving comfort and the shaving performance as desired by him. The operational member 205, which is shown in FIG. 1 with a broken line, is provided on the housing 3 of the shaving apparatus 201 and comprises a selection slide 207 which may be set in a number of positions by the user. As FIG. 9 shows, the control unit 203 has a first electrical input 209 for receiving a first electrical input signal $u_T$ which corresponds to the time T which has elapsed during a shaving operation, a second electrical input 211 for receiving a second electrical input signal $u_C$ which corresponds to the skin contact force exerted on the cutting units 11, and a third electrical input 213 for receiving a third electrical input signal us supplied by the operational member 205 and corresponding to a desired balance between the shaving performance and the shaving comfort as set by the user. The first electrical input signal $u_T$ is supplied by a timer 59, which corresponds to the timer 59 of the shaving apparatus 1 described above and forms a first transducer of the shaving apparatus 201. The control unit 203 also comprises a calculation unit 65 with a memory 67, which corresponds to the calculation unit 65 of the control unit 43 of the shaving apparatus 1 and calculates an average shaving time from a large number of preceding shaving operations. An output signal $u_{\%T}$ of the calculation unit 65 corresponds to the quotient of a time which has elapsed during a shaving operation (input signal $u_T$) and the calculated average shaving time. The shaving apparatus 201 comprises, as does the shaving apparatus 101, described above, three strain gauge sensors 111 which form a second transducer of the shaving apparatus 201 and are each provided on a strip-shaped mechanical spring 113. The strain gauge sensors 111 and the strip-shaped springs 113 of the shaving apparatus 201 correspond to the strain gauge sensors 111 and the strip-shaped springs 113 of the shaving apparatus 101. The second electrical input signal $u_C$ of the control unit 203 is supplied by a first processor 109 which corresponds to the first processor 109 of the shaving apparatus 101 and which calculates an average of three signals $u_{C1}$, $u_{C2}$ and $u_{C3}$ which each correspond to a skin contact force exerted on one of the cutting units 11 and measured by one of the strain gauge sensors 111, respectively.

As FIG. 9 further shows, the control unit 203 comprises a second processor 215 which determines the output signal $u_R$ corresponding to the desired speed of the motor 23 as a function of the output signal $u_{\%T}$ of the calculation unit 65, the second input signal $u_C$ and the third input signal $U_S$. Furthermore, an electrical filter 117, which corresponds to the electrical filter 117 of the control unit 103 of the shaving apparatus 101, is connected between the second electrical input 211 and the second processor 215. The desired speed is determined by the second processor 215 in accordance with a control rule according to which the desired speed decreases as the elapsed time during a shaving operation increases. As has been ascertained beforehand, the number of hairs to be cut per unit skin surface on an average user of the shaving apparatus 201 is greater in an initial phase of the shaving operation than in the end phase of the shaving operation. Thus the motor speed required in the initial phase for obtaining a sufficient stability of the rotating internal cutting members 19 is greater than the motor speed required in the end phase. According to the control rule, furthermore, the desired motor speed increases with an increase in the measured skin contact force if the operational member 205 has been set in a position (P) in which the user desires a comparatively high shaving performance and a comparatively low shaving comfort, whereas the desired motor speed decreases with an increase in the measured skin contact force if the operational member 205 has been set in a position (C) in which the user desires a comparatively low shaving performance and a comparatively high shaving comfort. When the skin contact force increases, the skin penetrates more deeply into the hair trap openings 17 of the external cutting members 13, so that the number of hairs to be cut by the cutting units 11 per unit time increases. In addition, the risk of contacts made between the skin and the rotating internal cutting members 19 increases. With the operational member 205 in position P, the speed of the motor 23 increases with an increasing skin contact force, so that the stability of the rotating internal cutting members 19 increases and the shaving performance increases to the detriment of the shaving comfort. With the operational member in position C, the speed of the motor 23 decreases with an increasing skin contact force, so that the number of contacts made by the internal cutting members 19 with the skin per unit time decreases, and the shaving comfort is maintained to the detriment of the shaving performance in spite of the higher skin contact force. As FIG. 1 shows, the operational member 205 may also be set in an intermediate position (M), in which the user desires an average balance between the shaving performance and shaving comfort. In the intermediate position of the operational member 205, the desired motor speed is independent of the measured skin contact force according to the control rule, and depends exclusively on the time which has elapsed during the shaving operation.

The control rule according to which the control unit 203 determines the output signal $u_R$ as a function of the input signals $u_{\%T}$, $u_C$ and $u_S$ contains, as do the control rules of the control units 43 and 103 of the shaving apparatuses 1 and 101, an algorithm based on fuzzy logic. FIG. 10 shows an embodiment of the classes and membership functions of the input signals $u_{\%T}$, $u_C$ and $u_S$ and the output signal $u_R$ of the second processor 215. The classes and membership functions of the input signal $u_{\%T}$ and of the output signal $u_R$ correspond to the classes and membership functions of the input signal $u_{\%T}$ and the output signal $u_R$ of the processor 75 of the shaving apparatus 1 as shown in FIG. 4. The input signal $u_C$ is subdivided into the classes L (low), M (medium) and H (high), while the input signal $u_S$ is divided into the classes P (high shaving performance, low shaving comfort), M (average shaving performance and shaving comfort), and C (low shaving performance, high shaving comfort). FIG. 11, finally, is a Table showing the class assigned to the output signal $u_R$ by the second processor 215 in accordance with a logic rule in relation to the classes assigned to the input signals $u_{\%T}$, $u_C$ and $u_S$.

It is noted that the shaving apparatuses 1, 101, 201, described above are each provided with three cutting units 11 with an external cutting member 13 and an internal cutting member 19 which is rotatable in the external cutting member 13. The invention may also be applied, however, to shaving apparatus provided with a cutting unit with an external cutting member and an internal cutting member which performs a vibratory or oscillating movement relative to the external cutting member. Furthermore, the invention may also be applied to shaving apparatus which have a different number of cutting units, for example, only one or two.

It is further noted that a control unit of a different type than the control unit 43, 103, 203 may be used for controlling the speed of the motor 23. Instead of the control unit 43, 103, 203, which is based on a control role in accordance with fuzzy logic, for example, a control unit may be used based on usual mathematical relations. The control unit 43, 103, 203 may also contain a different control rule, i.e. a different relation between the input signals and the output signal.

It is further noted that the speed of the shaving apparatus 1, 101, 201, can be controlled by the control unit 43, 103, 203 as a function of two physical quantities. According to the invention, however, the speed may alternatively be controllable as a function of only one physical quantity or as a function of more than two physical quantities, while also quantities may be used different from the quantities mentioned in the embodiments. The shaving apparatus according to the invention, furthermore, may or may not be equipped with an operational member for setting the desired balance between shaving comfort and shaving performance.

It is finally noted that the physical quantities mentioned in the embodiments may be measured by means of different types of transducers. Thus, for example, the skin contact force between the skin and the external cutting member may alternatively be measured by a sensor which detects the position of the external cutting members relative to the holder, in which case the skin contact force can be derived from the detected position and the stiffness of the mechanical springs deformed by the displacement.

We claim:

1. A shaving apparatus which comprises: at least one electric motor, at least one electrical control unit, at least one transducer operatively associated with said at least one control unit, at least one cutting unit which is provided with an external cutting member with at least one hair trap opening and an internal cutting member which can be driven relative to the external cutting member by said electric motor, which motor has a speed which is controllable by means of said electrical control unit, and wherein the electrical control unit varies the motor speed in accordance with a predetermined control rule as a function of at least one physical quantity which is measurable by means of the at least one transducer.

2. A shaving apparatus as claimed in claim 1, wherein the transducer is capable of measuring a number of hairs cut by the cutting unit per unit time.

3. A shaving apparatus as claimed in claim 2, wherein the transducer is provided with a microphone capable of detecting an acoustic signal produced by the cutting unit, and with an electrical filter capable of filtering a cutting frequency from said acoustic signal.

4. A shaving apparatus as claimed in claim 2 wherein according to the control rule the motor speed increases with an increase in the measured number of hairs cut by the cutting unit per unit time.

5. A shaving apparatus as claimed in claim 1, wherein the transducer is capable of measuring a time which has elapsed during a shaving operation.

6. A shaving apparatus as claimed in claim 5, wherein the control unit is provided with a calculation unit for calculating an average shaving time over a number of preceding shaving operations, the control unit determining the time which has elapsed during a shaving operation in relation to the calculated average shaving time.

7. A shaving apparatus as claimed in claim 5 wherein according to the control rule the motor speed decreases with an increase in the time which has elapsed during a shaving operation.

8. A shaving apparatus as claimed in claim 1, wherein the transducer is capable of measuring a skin contact force exerted on the cutting unit.

9. A shaving apparatus as claimed in claim 2 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a time which has elapsed during a shaving operation, the control unit having an electrical output for supplying an output signal which corresponds to a motor speed determined in accordance with the control rule.

10. A shaving apparatus as claimed in claim 9, wherein, for a predetermined increase in the measured number of hairs cut by the cutting unit per unit time, the motor speed increases comparatively little according to the control rule when the time which has elapsed during a shaving operation is comparatively short, and increases comparatively strongly when the time which has elapsed during a shaving operation is comparatively long.

11. A shaving apparatus as claimed in claim 2 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit having an electrical output for supplying an output signal which corresponds to a motor speed determined in accordance with the control rule.

12. A shaving apparatus as claimed in claim 11, wherein according to the control rule the motor speed decreases when the skin contact force exerted on the cutting unit increases.

13. A shaving apparatus as claimed in claim 2 wherein the transducer capable of measuring a time which has elapsed during a shaving operation is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit having an electrical output for supplying an output signal which corresponds to a motor speed determined in accordance with the control rule.

14. A shaving apparatus as claimed in claim 13, wherein according to the control rule the motor speed is substantially independent of the skin contact force exerted on the cutting unit when the time which has elapsed during a shaving operation is comparatively short, whereas the motor speed decreases with an increase in the skin contact force exerted on the cutting unit when the time which has elapsed during a shaving operation is comparatively long.

15. A shaving apparatus as claimed in claim 1 wherein, the control unit has an electrical input which is connected to an electrical output of an operational member with which a desired balance between shaving performance and shaving comfort can be set.

16. A shaving apparatus as claimed in claim 1 wherein, the control rule controls the motor speed in accordance with an algorithm based on fuzzy logic.

17. A shaving apparatus as claimed in claim 1 wherein, the control unit has an electrical input which is connected to an electrical output of a sensor capable of measuring the speed of the electric motor.

18. A shaving apparatus as claimed in claim 3 wherein according to the control rule the motor speed increases with an increase in the measured number of hairs cut by the cutting unit per unit time.

19. A shaving apparatus as claimed in claim 6 wherein according to the control rule the motor speed decreases with an increase in the time which has elapsed during a shaving operation.

20. A shaving apparatus as claimed in claim 3 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a time which has elapsed during the shaving operation, the control unit having an electrical output for supplying an output signal which corresponds to a motor speed determined in accordance with the control rule.

21. A shaving apparatus as claimed in claim 4 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a time which has elapsed during the shaving operation, the control unit having an electrical output for supplying an output signal which corresponds to a motor speed determined in accordance with the control rule.

22. A shaving apparatus as claimed in claim 5 wherein a transducer capable of measuring a number of hairs cut by the cutting unit per unit time is a first transducer of the shaving apparatus connected to a first electrical input of the control unit, and the transducer capable of measuring a time which has elapsed during a shaving operation is a second transducer of the shaving apparatus connected to a second electrical input of the control unit, which control unit has an electrical output for supplying an output signal which corresponds to a motor speed determined in accordance with the control rule.

23. A shaving apparatus as claimed in claim 6 wherein a transducer capable of measuring a number of hairs cut by the cutting unit per unit time is a first transducer of the shaving apparatus connected to a first electrical input of the control unit, and the transducer capable of measuring a time which has elapsed during a shaving operation is a second transducer of the shaving apparatus connected to a second electrical input of the control unit, which control unit has an electrical output for supplying an output signal which corresponds to a motor speed determined in accordance with the control rule.

24. A shaving apparatus as claimed in claim 7 wherein a transducer capable of measuring a number of hairs cut by the cutting unit per unit time is a first transducer of the shaving apparatus connected to a first electrical input of the control unit, and the transducer capable of measuring a time which has elapsed during a shaving operation is a second transducer of the shaving apparatus connected to a second electrical input of the control unit, which control unit has an electrical output for supplying an output signal which corresponds to a motor speed determined in accordance with the control rule.

25. A shaving apparatus as claimed in claim 3 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit has an electrical output for supplying an output signal which corresponds to a motor speed determined in accordance with the control rule.

26. A shaving apparatus as claimed in claim 4 wherein the transducer capable of measuring a number of hairs cut by the cutting unit per unit time is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit having an electrical output for supplying an output signal which corresponds to a motor speed determined in accordance with the control rule.

27. A shaving apparatus as claimed in claim 8 which includes a first and a second transducer wherein a transducer capable of measuring a number of hairs cut by the cutting unit per unit time is a first transducer of the shaving apparatus connected to a first electrical input of the control unit, and a transducer capable of measuring a skin contact force exerted on the cutting unit is a second transducer of the shaving apparatus connected to a second electrical input of the control unit, while the control unit has an electrical output for supplying an output signal which corresponds to a motor speed determined in accordance with the control rule.

28. A shaving apparatus as claimed in claim 6 wherein the transducer capable of measuring a time which has elapsed during a shaving operation is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit having an electrical output for supplying an output signal which corresponds to a motor speed determined in accordance with the control rule.

29. A shaving apparatus as claimed in claim 7 wherein the transducer capable of measuring a time which has elapsed during a shaving operation is a first transducer of the shaving apparatus connected to a first electrical input of the control unit, and a second transducer of the shaving apparatus is connected to a second electrical input of the control unit, which transducer is capable of measuring a skin contact force exerted on the cutting unit, the control unit having an electrical output for supplying an output signal which corresponds to a motor speed determined in accordance with the control rule.

30. A shaving apparatus as claimed in claim 8 which includes a first and a second transducer wherein a transducer capable of measuring a time which has elapsed during a shaving operation is a first transducer of the shaving apparatus connected to a first electrical input of the control unit, and the transducer capable of measuring a skin contact force exerted on the cutting unit is a second transducer of the shaving apparatus connected to a second electrical input of the control unit, while the control unit has an electrical output for supplying an output signal which corresponds to a motor speed determined in accordance with the control rule.

31. A shaving apparatus as claimed in claim 2 wherein the control unit has an electrical input which is connected to an electrical output of a sensor capable of measuring the speed of the electric motor.

32. A shaving apparatus as claimed in claim 3 wherein the control unit has an electrical input which is connected to an electrical output of a sensor capable of measuring the speed of the electric motor.

33. A shaving apparatus as claimed in claim 4 wherein the control unit has an electrical input which is connected to an electrical output of a sensor capable of measuring the speed of the electric motor.

34. A shaving apparatus as claimed in claim 5 wherein the control unit has an electrical input which is connected to an electrical output of a sensor capable of measuring the speed of the electric motor.

35. A shaving apparatus as claimed in claim 6 wherein the control unit has an electrical input which is connected to an electrical output of a sensor capable of measuring the speed of the electric motor.

36. A shaving apparatus as claimed in claim 7 wherein the control unit has an electrical input which is connected to an electrical output of a sensor capable of measuring the speed of the electric motor.

37. A shaving apparatus as claimed in claim 8 wherein the control unit has an electrical input which is connected to an electrical output of a sensor capable of measuring the speed of the electric motor.

38. A shaving apparatus as claimed in claim 9 wherein the control unit has an electrical input which is connected to an electrical output of a sensor capable of measuring the speed of the electric motor.

39. A shaving apparatus as claimed in claim 10 wherein the control unit has an electrical input which is connected to an electrical output of a sensor capable of measuring the speed of the electric motor.

40. A shaving apparatus as claimed in claim 11 wherein the control unit has an electrical input which is connected to an electrical output of a sensor capable of measuring the speed of the electric motor.

41. A shaving apparatus as claimed in claim 12 wherein the control unit has an electrical input which is connected to an electrical output of a sensor capable of measuring the speed of the electric motor.

42. A shaving apparatus as claimed in claim 13 wherein the control unit has an electrical input which is connected to an electrical output of a sensor capable of measuring the speed of the electric motor.

43. A shaving apparatus as claimed in claim 14 wherein the control unit has an electrical input which is connected to an electrical output of a sensor capable of measuring the speed of the electric motor.

44. A shaving apparatus as claimed in claim 15 wherein the control unit has an electrical input which is connected to an electrical output of a sensor capable of measuring the speed of the electric motor.

45. A shaving apparatus as claimed in claim 16 wherein the control unit has an electrical input which is connected to an electrical output of a sensor capable of measuring the speed of the electric motor.

46. A shaving apparatus which comprises: at least one electric motor, at least one control unit, at least one transducer operatively associated with said at least one electrical control unit, at least one cutting unit which is provided with an external cutting member with at least one hair trap opening and an internal cutting member which can be driven relative to the external cutting member by said electric motor, which motor has a speed which is controllable by means of said control unit, wherein the control unit is a feedforward computer which varies the motor speed in accordance with a predetermined control rule as a function of the at least one transducer determining at least one physical quantity which is measurable by the at least one transducer and is selected from the group consisting of (1) the number of hairs cut by the cutting unit per unit time; (2) a time which has elapsed during a shaving operation; (3) a skin contact force exerted on the cutting unit; and (4) combinations thereof.

47. A shaving apparatus as claimed in claim 45 wherein according to the control rule the motor speed increases with an increase in the measured number of hairs cut by the cutting unit per unit time.

48. A shaving apparatus as claimed in claim 46 wherein according to the control rule the motor speed decreases with an increase in the time which has elapsed during a shaving operation.

49. A shaving apparatus as claimed in claim 46 wherein the transducer capable of measuring a number of hairs cut by the cutting unit per unit time is a first transducer of the shaving apparatus connected to a first electrical input of the control unit, and the transducer capable of measuring a time which has elapsed during a shaving operation is a second transducer of the shaving apparatus connected to a second electrical input of the control unit, which control unit has an electrical output for supplying an output signal which corresponds to a motor speed determined in accordance with the control rule.

50. A shaving apparatus as claimed in claim 46 wherein the transducer capable of measuring a number of hairs cut by the cutting unit per unit time is a first transducer of the shaving apparatus connected to a first electrical input of the control unit, and the transducer capable of measuring a skin contact force exerted on the cutting unit is a second transducer of the shaving apparatus connected to a second electrical input of the control unit, while the control unit has an electrical output for supplying an output signal which corresponds to a motor speed determined in accordance with the control rule.

51. A shaving apparatus as claimed in claim 46 wherein the control unit has an electrical input which is connected to an electrical output of a sensor capable of measuring the speed of the electric motor.

52. A shaving apparatus which comprises: at least one electric motor, at least one control unit, at least one transducer operatively associated with said at least one electrical control unit, at least one cutting unit which is provided with an external cutting member with at least one hair trap opening and an internal cutting member which can be driven relative to the external cutting member by said electric motor, which motor has a speed which is controllable by means of said control unit, wherein the control unit is a feedforward computer which varies the motor speed in accordance with a predetermined control rule as a function of the at least one transducer determining at least the number of hairs cut by the cutting unit per unit time.

53. A shaving apparatus which comprises: at least one electric motor, at least one control unit, at least one transducer operatively associated with said at least one electrical control unit, at least one cutting unit which is provided with an external cutting member with at least one hair trap opening and an internal cutting member which can be driven relative to the external cutting member by said electric motor, which motor has a speed which is controllable by means of said control unit, wherein the control unit is a feedforward computer which varies the motor speed in accordance with a predetermined control rule as a function of the at least one transducer determining at least a time which has elapsed during a shaving operation.

54. A shaving apparatus which comprises: at least one electric motor, at least one control unit, at least one transducer operatively associated with said at least one electrical control unit, at least one cutting unit which is provided with an external cutting member with at least one hair trap opening and an internal cutting member which can be driven relative to the external cutting member by said electric motor, which motor has a speed which is controllable by means of said control unit, wherein the control unit is a feedforward computer which varies the motor speed in accordance with a predetermined control rule as a function of the at least one transducer determining at least a skin contact force exerted on the cutting unit.

55. A shaving apparatus as claimed in claim 52 wherein the control unit has an electrical input which is connected to an electrical output of a sensor capable of measuring the speed of the electric motor.

* * * * *